US006143488A

United States Patent [19]

Uytterhoeven et al.

[11] Patent Number: 6,143,488

[45] **Date of Patent: *Nov. 7, 2000**

[54] PHOTOTHERMOGRAPHIC RECORDING MATERIAL COATABLE FROM AN AQUEOUS MEDIUM

[75] Inventors: Herman Uytterhoeven, Bonheiden; Johan Loccufier, Zwijnaarde, both of Belgium

[73] Assignee: Agfa-Gevaert, Mortsel, Belgium

[ * ] Notice: This patent issued on a continued prosecution application filed under 37 CFR 1.53(d), and is subject to the twenty year patent term provisions of 35 U.S.C. 154(a)(2).

[21] Appl. No.: 08/999,488

[22] Filed: Dec. 29, 1997

Related U.S. Application Data

[60] Provisional application No. 60/038,763, Feb. 20, 1997.

[30] Foreign Application Priority Data

Dec. 30, 1996 [EP] European Pat. Off. ..... 96203730

[51] Int. Cl.[7] ..... G03C 1/498

[52] U.S. Cl. ..... 430/619; 430/531; 430/600; 430/613; 430/617; 430/965

[58] Field of Search ..... 430/619, 965, 430/617, 600, 613, 523, 531

[56] References Cited

U.S. PATENT DOCUMENTS

| | | | |
|---|---|---|---|
| 4,105,451 | 8/1978 | Smith et al. . | |
| 4,123,282 | 10/1978 | Winslow . | |
| 4,157,289 | 6/1979 | Ikenoue et al. . | |
| 4,442,202 | 4/1984 | Shiga et al. . | |
| 5,350,669 | 9/1994 | Witcomb et al. | 430/618 |

FOREIGN PATENT DOCUMENTS

| | | |
|---|---|---|
| 1447454 | 6/1973 | Japan . |
| 2002917A | 8/1978 | United Kingdom . |
| 96 33442 | 10/1996 | WIPO . |

*Primary Examiner*—Thorl Chea
*Attorney, Agent, or Firm*—Baker Botts L.L.P.

[57] ABSTRACT

A process for producing a photothermographic recording material having a support and a photo-addressable thermally developable element containing photosensitive silver halide in catalytic association with a substantially light-insensitive silver salt of an organic carboxylic acid, an organic reducing agent for the substantially light-insensitive silver salt of an organic carboxylic acid in thermal working relationship therewith and a binder including a water-soluble binder, a water-dispersible binder or a mixture of a water-soluble binder and a water-dispersible binder, comprising the steps of: (i) producing an aqueous dispersion or aqueous dispersions containing photosensitive silver halide, a substantially light-insensitive silver salt of an organic carboxylic acid, an organic reducing agent for the substantially light-insensitive silver salt of an organic carboxylic acid and a binder including a water-soluble binder, a water-dispersible binder or a mixture of a water-soluble binder and a water-dispersible binder; (ii) coating the aqueous dispersion or aqueous dispersions onto a support thereby forming a photo-addressable thermally developable element on the support, wherein at least 80 mol % of the photosensitive silver halide is silver iodide and the aqueous dispersion further contains or the aqueous dispersions further contain a diazine compound.

7 Claims, No Drawings

PHOTOTHERMOGRAPHIC RECORDING MATERIAL COATABLE FROM AN AQUEOUS MEDIUM

The application claims the benefit of U.S. Provisional Application No. 60/038,763 filed Feb. 20, 1997.

DESCRIPTION

1. Field of the Invention

The present invention relates to a photothermographic recording material comprising a photo-addressable thermally developable element coatable from aqueous media.

2. Background of the Invention.

Thermal imaging or thermography is a recording process wherein images are generated by the use of thermal energy. In direct thermal imaging a visible image pattern is formed by imagewise heating of a recording material containing matter that by chemical or physical process changes colour or optical density. Such thermographic materials become photothermographic when a photosensitive agent is present which after exposure to UV, visible or IR light is capable of catalyzing or participating in a thermographic process bringing about changes in colour or optical density.

Examples of photothermographic materials are the so called "Dry Silver" photographic materials of the 3M Company, which are reviewed by D. A. Morgan in "Handbook of Imaging Science", edited by A. R. Diamond, page 43, published by Marcel Dekker in 1991.

U.S. Pat. No. 3,152,904 discloses an image reproduction sheet which comprises a radiation-sensitive heavy metal salt which can be reduced to free metal by a radiation wave length between an X-ray wave length and a five microns wave length and being distributed substantially uniformly laterally over the sheet, and as the image forming component an oxidation-reduction reaction combination which is substantially latent under ambient conditions and which can be initiated into reaction by the free metal to produce a visible change in colour comprising an organic silver salt containing carbon atoms and different from the heavy metal salt as an oxidizing agent and in addition an organic reducing agent containing carbon atoms, the radiation-sensitive heavy metal salt being present in an amount between about 50 and about 1000 parts per million of the oxidation-reduction reaction combination.

JP 54-156527 discloses a heat-developing photosensitive material containing (a) an oxidizing agent comprising non-photosensitive organic silver salt, (b) iodine, (c) a reducing agent for silver ions and (d) an N-containing organic base which may or may not have an acidic proton in a molecule and has a pKa of conjugated acid 0.5 to 10, with preferred (d) being, for example, pyridine, quinoline, quinazoline, phthalazine, their derivatives etc. Furthermore, U.S. Pat. No. 3,994,732 discloses a photosensitive, heat-developable, dry silver sheet material containing an image-forming system including a photosensitive silver halide catalyst-forming means and as heat image forming means, an organic silver compound and a reducing agent therefor, the oxidation reduction reaction of which to produce a visible image is accelerated by the catalyst, and sufficient toner to increase the density of the visible image, the improvement characterized by the toner being a mixture of (a) phthalazine and (b) at least one acid of the formula: R-A-$R_1$ wherein A is phenyl or naphthyl and R and $R_1$ are selected from —COOH and —$CH_2$COOH, R and $R_1$ bonded respectively to the 2 and 3 positions of A, and anhydrides of the acid R-A-$R_1$.

U.S. Pat. No. 4,442,202 discloses in its invention example 5 photothermographic material A16 comprising a silver behenate emulsion layer produced from a silver behenate suspension in toluene and methyl ethyl ketone (mixing weight ratio=1:2), polyvinyl butyral, silver iodide and silver bromide amongst other ingredients overcoated with a solution containing a reducing agent, phthalazinone and cellulose acetate butyrate. The mol % of silver iodide to silver halide present in the silver behenate emulsion layer was 80.4%.

The standard teaching over such photothermographic materials based on a substantially light-insensitive organic silver salt, photosensitive silver halide in intimate catalytic association with the organic silver salt and a reducing agent for the organic silver salt is that the organic silver salt is formed, optionally in the presence of ex situ formed silver halide, in an aqueous medium and is precipitated and dried before dispersion in an organic solvent medium from which the dispersion is coated, the silver halide either being prepared ex situ, and either added to a dispersion of the organic silver salt as described in U.S. Pat. No. 3,080,254 or being present during the formation of the organic silver salt as disclosed in U.S. Pat. No. 3,839,049, or being prepared in situ from the organic silver salt by reaction with a halide ion source as disclosed in U.S. Pat. No. 3,457,075. In the latter case reaction of organic silver salt with a halide ion source, which can be inorganic or organic, occurs after the dispersion of the organic silver salt in a solvent medium and hence the reaction takes place in a non-aqueous medium.

This production method is very inefficient as the organic silver salt after formation in water has to be separated and dried before dispersion in a solvent medium, is environmentally unsound as evaporation of solvent takes place during the coating process and it involves lengthy utilization of plant during the preparation of the organic silver salt dispersion and coating requires costly plant due to the need for solvent explosion prevention measures and solvent recovery to prevent solvent emission to the environment. Furthermore, it is desirable spectrally to sensitize photosensitive silver halide in water-containing media as this permits the use of a broader range of spectrally sensitizing dyes.

Recent unpublished PCT-applications PCT/EP/02579 to PCT/EP/02583 attempt to remedy this deficiency, but the materials have unsatisfactory post-processing stability.

OBJECTS OF THE INVENTION

It is a first object of the invention to provide a photothermographic recording material comprising a photo-addressable thermally developable element with excellent image-forming properties.

It is a second object of the invention to provide a photothermographic recording material comprising a photo-addressable thermally developable element based on a substantially light-insensitive silver salt of an organic carboxylic acid, photosensitive silver halide in catalytic association therewith and an organic reducing agent for the silver salt of an organic carboxylic acid, which is producible without necessitating intermediate drying of the silver salt of an organic carboxylic acid.

It is another object of the invention to provide a photothermographic recording material comprising a photo-addressable thermally developable element based on a substantially light-insensitive silver salt of an organic carboxylic acid, photosensitive silver halide in catalytic association therewith and an organic reducing agent for the silver salt of an organic carboxylic acid, which is coatable from an aqueous medium.

It is a further object of the invention to provide a photothermographic recording material with improved post-processing stability.

Further objects and advantages of the invention will become apparent from the description hereinafter.

SUMMARY OF THE INVENTION

According to the present invention a process is provided for producing a photothermographic recording material having a support and a photo-addressable thermally developable element containing photosensitive silver halide in catalytic association with a substantially light-insensitive silver salt of an organic carboxylic acid, an organic reducing agent for the substantially light-insensitive silver salt of an organic carboxylic acid in thermal working relationship therewith and a binder including a water-soluble binder, a water-dispersible binder or a mixture of a water-soluble binder and a water-dispersible binder, comprising the steps of: (i) producing an aqueous dispersion or aqueous dispersions containing photosensitive silver halide, a substantially light-insensitive silver salt of an organic carboxylic acid, an organic reducing agent for the substantially light-insensitive silver salt of an organic carboxylic acid and a binder including a water-soluble binder, a water-dispersible binder or a mixture of a water-soluble binder and a water-dispersible binder; (ii) coating the aqueous dispersion or aqueous dispersions onto a support thereby forming a photo-addressable thermally developable element on the support, wherein at least 80 mol % of the photosensitive silver halide is silver iodide and the aqueous dispersion further contains or the aqueous dispersions further contain a diazine compound.

A photothermographic recording material is also provided comprising a support and a photo-addressable thermally developable element containing photosensitive silver halide in catalytic association with a substantially light-insensitive silver salt of an organic carboxylic acid, an organic reducing agent for the substantially light-insensitive silver salt of an organic carboxylic acid in thermal working relationship therewith and a binder including a water-soluble binder, a water-dispersible binder or a mixture of a water-soluble binder and a water-dispersible binder, wherein at least 80 mol % of the photosensitive silver halide is silver iodide and the photo-addressable thermally developable element further contains phthalazine or a substituted phthalazine compound.

Preferred embodiments of the present invention are disclosed in the detailed description of the invention.

DETAILED DESCRIPTION OF THE INVENTION

Aqueous

The term aqueous for the purposes of the present invention includes mixtures of water with water-miscible organic solvents such as alcohols e.g. methanol, ethanol, 2-propanol, butanol, iso-amyl alcohol, octanol, cetyl alcohol etc.; glycols e.g. ethylene glycol; glycerine; N-methyl pyrrolidone; methoxypropanol; and ketones e.g. 2-propanone and 2-butanone etc.

Diazine Compounds

According to the present invention the term diazine compound includes heterocyclic ring systems with at least two azine groups, which may be in the same or in different heterocyclic rings annulated with one another as well as substituted diazine compounds and annulated diazine compounds which may themselves be substituted. Suitable substituting groups are, for example, alkyl, substituted alkyl, hydroxy, alkoxy, carboxy and carboxy-ester groups.

The diazine compound may also be present as a complex, for example as the silver-carboxylate disclosed in U.S. Pat. No. 5,350,669, as a metal salt, as an amine-complex or as a complex with inorganic salts. The diazine compound may be present in the same layer of the photo-addressable thermally developable element as the silver salt of an organic carboxylic acid or in a different layer such that it is in thermal working relationship therewith. It may also be incorporated as a dispersion in a dispersion medium which substantially prevents its diffusion during production and storage of the photothermographic material of the present invention, but which allows diffusion thereof during thermal development so that it can participate in the thermal development process. According to a preferred embodiment of the present invention the diazine compound is a 1,2-diazine compound or a substituted 1,2-diazine compound and in a particularly preferred embodiment the diazine compound is phthalazine or a substituted phthalazine.

Suitable diazine compounds, according to the present invention, are: phthalazine, pyridazine, cinnoline, benzo(c) cinnoline, naphthyridine, pyrimidine, pyrazine, quinazoline, quinoxaline, purine and substituted derivatives therefrom. Examples of preferred substituted diazine compounds are: 1(2H)-phthalazinone, substituted substituted 1(2H)-phthalazinones, 2,3-dihydro-1,4-phthalazinedione, substituted 2,3-dihydro-1,4-phthalazinediones and the like.

Water-Dispersible and Water-Soluble Binders

According to the present invention the photo-addressable thermally developable element includes a binder comprising a water-soluble binder, a water-dispersible binder or a mixture of a water soluble binder and a water-dispersible binder. In a preferred embodiment of the present invention the binder is a polymer latex.

The water-dispersible binder can be any water-insoluble polymer e.g. water-insoluble cellulose derivatives, polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylic acid esters, polymethacrylic acid esters, polystyrene and polyethylene or mixtures thereof. It should be noted that there is no clear cut transition between a polymer dispersion and a polymer solution in the case of very small polymer particles resulting in the smallest particles of the polymer being dissolved and those slightly larger being in dispersion.

Suitable water-soluble polymers, according to the present invention, are: gelatin, gelatin derivatives, polyvinyl alcohol, polyacrylamide, polyacrylic acid, polymethacrylic acid, polyethyleneglycol, polysaccharides, such as starch, gum arabic and dextran and water-soluble cellulose derivatives.

To improve the layer-forming properties of water-soluble and water-dispersible polymers, plasticizers can be incorporated into the polymers, water-miscible solvents can be added to the dispersion medium and mixtures of water-soluble polymers, mixtures of water-dispersible polymers, or mixtures of water-soluble and water-dispersible polymers may be used.

Photo-Addressable Thermally Developable Element

The photo-addressable thermally developable element, according to the present invention, contains photosensitive silver halide in catalytic association with a substantially light-insensitive silver salt of an organic carboxylic acid, an organic reducing agent for the substantially light-insensitive silver salt of an organic carboxylic acid in thermal working relationship therewith and a binder including a water-soluble binder, a water-dispersible binder or a mixture of a water-soluble binder and a water-dispersible binder, characterized in that at least 80 mol % of the photosensitive silver halide is silver iodide and the photo-addressable thermally developable element further contains a diazine compound. The element may comprise a layer system with the silver halide in catalytic association with the substantially light-insensitive silver salt of an organic carboxylic acid, spectral sensitizer optionally together with a supersensitizer in sensitizing association with the silver halide particles and the other ingredients active in the thermal development process or pre- or post-development stabilization of the element being in the same layer or in other layers with the proviso that the organic reducing agent and the toning agent, if present, is in thermal working relationship with the substantially light-insensitive silver salt of an organic carboxylic acid i.e. during the thermal development process the reducing agent are able to diffuse to the substantially light-insensitive silver salt of an organic carboxylic acid.

Light-Insensitive Silver Salt of an Organic Carboxylic Acids

Preferred substantially light-insensitive silver salts of organic carboxylic acids, according to the present invention, are silver salts of organic carboxylic acids having as their organic group: aryl, aralkyl, alkaryl or alkyl. For example aliphatic carboxylic acids known as fatty acids, wherein the aliphatic carbon chain has preferably at least 12 C-atoms, e.g. silver laurate, silver palmitate, silver stearate, silver hydroxystearate, silver oleate and silver behenate, which silver salts are also called "silver soaps". Silver salts of modified aliphatic carboxylic acids with thioether group, as described e.g. in GB-P 1,111,492, may likewise be used to produce a thermally developable silver image.

In a preferred embodiment, according to the present invention, the substantially light-insensitive silver salt of an organic carboxylic acid is a silver salt of a fatty acid. The term substantially light-insensitive silver salt of an organic carboxylic acid for the purposes of the present invention also includes mixtures of silver salts of organic carboxylic acids.

Production of Particles of Silver Salts of an Organic Carboxylic Acids

Particles of the silver salts of organic carboxylic acids are prepared by the reaction of a soluble silver salt with the organic carboxylic acid or a salt thereof.

According to a process for producing a photothermographic recording material, according to the present invention, the aqueous dispersion or the aqueous dispersions comprise an aqueous suspension of particles of a substantially light-insensitive silver salt of an organic carboxylic acid produced by simultaneous metered addition of an aqueous solution or suspension of an organic carboxylic acid, or its salt, and an aqueous solution of a silver salt to an aqueous liquid and the metered addition of the aqueous solution or suspension of the organic carboxylic acid or its salt; and/or the aqueous solution of the silver salt is regulated by the concentration of silver ions or the concentration of anions of the silver salt in the aqueous liquid.

A process for producing a photothermographic recording material is also provided by the present invention, wherein the process further comprises the step of producing particles of the photosensitive silver iodide from excess silver ions associated with particles of the substantially light-insensitive silver salt of an organic carboxylic acid.

Photosensitive Silver Halide

The photosensitive silver halide used in the present invention may be employed in a range of 0.1 to 35 mol percent of substantially light-insensitive silver salt of an organic carboxylic acid, with the range of 0.5 to 20 mol percent being preferred and the range of 1 to 12 mol percent being particularly preferred. In a preferred embodiment of the present invention at least 90 mol % of the photosensitive silver halide is silver iodide. The silver iodide may be present in any form which is photosensitive including, α-, β- and γ-phases.

The silver halide used in the present invention may be employed without modification. However, it may be chemically sensitized with a chemical sensitizing agent such as a compound containing sulphur, selenium, tellurium etc., or a compound containing gold, platinum, palladium, iron, ruthenium, rhodium or iridium etc., a reducing agent such as a tin halide etc., or a combination thereof. Details of these procedures are described in T. H. James, "The Theory of the Photographic Process", Fourth Edition, Macmillan Publishing Co. Inc., New York (1977), Chapter 5, pages 149 to 169.

Emulsion of Silver Salt of an Organic Carboxylic Acid and Photosensitive Silver Halide The silver halide may be added to the photo-addressable thermally developable element in any fashion which places it in catalytic proximity to the substantially light-insensitive silver salt of an organic carboxylic acid. Silver halide and the substantially light-insensitive silver salt of an organic carboxylic acid which are separately formed, i.e. ex-situ or "preformed", in a binder can be mixed prior to use to prepare a coating solution, but it is also effective to blend both of them for a long period of time. Furthermore, it is effective to use a process which comprises adding at least one iodine-containing compound, optionally together was a non-iodo halogen-containing compound, to the silver salt of an organic carboxylic acid partially to convert the substantially light-insensitive silver salt of an organic carboxylic acid to silver halide as disclosed in U.S. Pat. No. 3,457,075.

According to a preferred embodiment according to the present invention, particles of the photosensitive silver halide in the photo-addressable thermally developable element are uniformly distributed over and between particles of the substantially light-insensitive silver salt of an organic carboxylic acid, at least 80% by number of t he photosensitive silver halide p articles having a diameter, determined by transmission electron microscopy, of ≦40 nm In a further embodiment, according to the present invention, production of the suspension of particles containing a substantially light-in sensitive silver salt is immediately followed by the production of silver halide "in-situ" in the same recipient, thereby producing a photosensitive suspension.

The aqueous emulsion of the silver salt of an organic carboxylic acid optionally including photosensitive silver halide can, according to the present invention, also be produced from particles of the silver salt of an organic carboxylic acid optionally containing photosensitive silver halide by dispersing the particles in water in the presence of non-ionic or anionic surfactants or a mixture of non-ionic and anionic surfactants using any dispersion technique known to one skilled in the art such as ball milling, dispersion in a impingement mill (rotor-stator mixer), dispersion in a microfluidizer etc. A combination of dispersion techniques may also be used, for example using a first technique to produce a predispersion and a second technique to produce a fine dispersion.

Agents for the Conversion of Silver Behenate to Silver Halide

According to the present invention photosensitive silver halide particles may be produced by reacting an aqueous dispersion of particles of the substantially light-insensitive silver salt of an organic carboxylic acid with at least one halide conversion agent. Suitable halide conversion agents are: water-soluble inorganic halides, such as KI=potassium iodide;

organic compounds with ionizable halogen atoms, such as

IPA=2-iodo-propionic acid;

and onium salts with halide or polyhalide anions. Preferred onium salts according to the present invention are organo-phosphonium, organo-sulphonium and organo-nitrogen onium cations, with heterocyclic nitrogen onium (e.g. pyridinium), quaternary phosphonium and ternary sulphonium cations being preferred. Onium cations, according to the present invention, may be polymeric or non-polymeric. Preferred non-polymeric onium salts for partial conversion of particles of substantially light-insensitive silver salt of an organic carboxylic acid into photosensitive silver halide according to the present invention are:

nitrogen-onium polyhalides (NC), for example:

NC08=tetrabutylammonium iodide quaternary phosphonium polyhalides (PC), for example:

PC02=3-(triphenylphosphonium)-propionic acid bromide

PC03=3-(triphenyl-phosphonium)propionic acid iodide

PC09=methyl-triphenyl-phosphonium iodide and ternary sulfonium polyhalides (SC), for example:

SC01=trimethylsulfonium iodide

The onium salts are present in quantities of between 0.1 and 35 mol % with respect to the quantity of substantially light-insensitive silver salt of an organic carboxylic acid, with quantities between 0.5 and 20 mol % being preferred and with quantities between 1 and 12 mol % being particularly preferred.

The halide conversion agents, according to the present invention, may be added as solids or solutions or may in the case of onium salts be formed in the aqueous dispersion of particles of the substantially light-insensitive silver salt by metathesis between a salt with halide or polyhalide anions and onium salts with anions other than iodide or polyiodide.

Organic Reducing Agent

Suitable organic reducing agents for the reduction of the substantially light-insensitive organic heavy metal salts are organic compounds containing at least one active hydrogen atom linked to O, N or C. Particularly suitable organic reducing agents for the reduction the substantially light-insensitive silver salt of an organic carboxylic acid are non-sulfo-substituted 6-membered aromatic or heteroaromatic ring compounds with at least three substituents one of which is a hydroxy group at a first carbon atom and a second of which is a hydroxy or amino-group substituted on a second carbon atom one, three or five ring atoms removed in a system of conjugated double bonds from the first carbon atom in the compound, in which (i) the third substituent may be part of an annulated carbocyclic or heterocyclic ring system; (ii) the third substituent or a further substituent is not an aryl- or oxo-arylgroup whose aryl group is substituted with hydroxy-, thiol- or amino-groups; and (iii) the third substituent or a further substituent is a non-sulfo-electron withdrawing group if the second substituent is an amino-group. Particularly preferred reducing agents are substituted catechols or substituted hydroquinone with 3-(3',4'-dihydroxyphenyl)propionic acid, 3',4'-dihydroxybutyrophenone, methyl gallate, ethyl gallate and 1,5-dihydroxy-naphthalene being especially preferred.

During the thermal development process the reducing agent must be present in such a way that it is able to diffuse to the substantially light-insensitive silver salt of an organic carboxylic acid particles so that reduction of the substantially light-insensitive silver salt of an organic carboxylic acid can take place.

Auxiliary Reducing Agents

The above mentioned reducing agents, regarded as primary or main reducing agents, may be used in conjunction with so-called auxiliary reducing agents. Auxiliary reducing agents that may be used in conjunction with the above mentioned primary reducing agents are organic reducing metal salts, e.g. stannous stearate described in U.S. Pat. Nos. 3,460,946 and 3,547,648.

Spectral Sensitizer

According to a preferred embodiment of the present invention, the photo-addressable thermally developable element of the photothermographic recording material further comprises a dye with maximum absorbance in the wavelength range 600 to 1100 nm.

The photo-addressable thermally developable element of the photothermographic recording material, according to the present invention, may contain a spectral sensitizer, optionally together with a supersensitizer, for the silver halide. The silver halide may be spectrally sensitized with various known dyes including cyanine, merocyanine, styryl, hemicyanine, oxonol, hemioxonol and xanthene dyes optionally, particularly in the case of sensitization to infra-red radiation, in the presence of a so-called supersensitizer. Cyanine and merocyanine dyes with imino groups or carboxyl groups are particularly effective. Suitable sensitizers of silver halide to infra-red radiation include those disclosed in the EP-A's 465 078, 559 101, 616 014 and 635 756, the JN's 03-080251, 03-163440, 05-019432, 05-072662 and 06-003763 and the U.S. Pat. Nos. 4,515,888, 4,639,414, 4,713,316, 5,258,282 and 5,441,866. Suitable supersensitizers for use with infra-red spectral sensitizers are disclosed in EP-A's 559 228 and 587 338 and in the U.S. Pat. Nos. 3,877,943 and 4,873,184.

Thermal Solvents

The above mentioned binders or mixtures thereof may be used in conjunction with waxes or "heat solvents" also called "thermal solvents" or "thermosolvents" improving the reaction speed of the redox-reaction at elevated temperature. By the term "heat solvent" in this invention is meant a non-hydrolyzable organic material which is in a solid state in the recording layer at temperatures below 50° C., but becomes a plasticizer for the recording layer where thermally heated and/or a liquid solvent for at least one of the redox-reactants, e.g. the reducing agent for the substantially light-insensitive silver salt of an organic carboxylic acid, at a temperature above 60° C.

Toning Agents

In order to obtain a neutral black image tone in the higher densities and neutral grey in the lower densities, photothermographic materials according to the present invention may contain one or more toning agents. The toning agents should be in thermal working relationship with the substantially light-insensitive silver salts and reducing agents during thermal processing. Any known toning agent from thermography or photothermography may be used.

Stabilizers and Antifoggants

In order to obtain improved shelf-life and reduced fogging, stabilizers and antifoggants may be incorporated into the photothermographic materials of the present invention. Examples of suitable stabilizers and antifoggants and their precursors, which can be used alone or in combination, include the thiazolium salts described in U.S. Pat. Nos. 2,131,038 and 2,694,716; the azaindenes described in U.S. Pat. Nos. 2,886,437 and 2,444,605; the urazoles described in U.S. Pat. No. 3,287,135; the sulfocatechols described in U.S. Pat. No. 3,235,652; the oximes described in GB-P 623,448; the thiuronium salts described in U.S. Pat. No. 3,220,839; the palladium, platinum and gold salts described in U.S. Pat. Nos. 2,566,263 and 2,597,915; the tetrazolyl-thio-compounds described in U.S. Pat. No. 3,700,457; the mesoionic 1,2,4-triazolium-3-thiolate stablizer precursors described in U.S. Pat. Nos. 4,404,390 and 4,351,896; the tribromomethyl ketone compounds described in EP-A 600 587; the combination of isocyanate and halogenated compounds described in EP-A 600 586; the vinyl sulfone and β-halo sulfone compounds described in EP-A 600 589; and those compounds mentioned in this context in Chapter 9 of "Imaging Processes and Materials, Neblette's 8th edition", by D. Kloosterboer, edited by J. Sturge, V. Walworth and A. Shepp, page 279, Van Nostrand (1989); in Research Disclosure 17029 published in June 1978; and in the references cited in all these documents.

Surfactants

Non-ionic, cationic or anionic surfactants may be used, according to the present invention, to produce dispersions of particles of substantially light-insensitive silver salt of an organic carboxylic acids and water-dispersible binders, such as polymer latexes, in aqueous media.

Additional Ingredients

In addition to the ingredients the photothermographic recording material may contain other additives such as free organic carboxylic acids, antistatic agents, silicone oil, e.g. BAYSILONE Ö1 A (tradename of BAYER AG—GERMANY), ultraviolet (UV) light absorbing compounds, white light reflecting and/or UV radiation reflecting pigments, silica, and/or optical brightening agents.

Antihalation Dyes

In addition to the ingredients, the photothermographic recording material of the present invention may contain antihalation or acutance dyes which absorb light which has passed through the photosensitive layer, thereby preventing its reflection. Such dyes may be incorporated into the photo-addressable thermally developable element or in any other layer comprising the photothermographic recording material of the present invention. The anti-halation dye may also be bleached either thermally during the thermal development process, or photo-bleached after removable after the thermal development process, as disclosed in the U.S. Pat. Nos. 3,984,248, 3,988,154, 3,988,156, 4,111,699 and 4,359,524. Furthermore the anti-halation layer may be contained in a layer which can be removed subsequent to the exposure process, as disclosed in U.S. Pat. No. 4,477,562 and EP-A 491 457. Suitable antihalation dyes for use with infra-red light are described in the EP-A's 377 961 and 652 473, the EP-B's 101 646 and 102 781 and the U.S. Pat. Nos. 4,581,325 and 5,380,635.

Support

The support for the photothermographic recording material according to the present invention may be transparent, translucent or opaque and is preferably a thin flexible carrier made e.g. from paper, polyethylene coated paper or transparent resin film, e.g. a cellulose ester, polypropylene, polystyrene, polymethacrylic acid ester, polycarbonate or polyester, e.g. polyethylene terephthalate or polyethylene naphthalate. The support may be in sheet, ribbon or web form and subbed if needs be to improve the adherence to the thereon coated heat-sensitive recording layer.

Suitable subbing layers for improving the adherence of the photo-addressable thermally developable element and the antistatic layer outermost backing layer of the present invention for polyethylene terephthalate supports are described e.g. in GB-P 1,234,755, U.S. Pat. Nos. 3,397,988; 3,649,336; 4,123,278, U.S. Pat. No. 4,478,907 and in Research Disclosure published in Product Licensing Index, July 1967, p. 6. Suitable pretreatments of hydrophobic resin supports are, for example, treatment with a corona discharge and/or attack by solvent(s), thereby providing a micro-roughening.

Protective Layer

According to a preferred embodiment of the photothermographic recording material of the present invention, the photo-addressable thermally developable element is provided with a protective layer to avoid local deformation of the photo-addressable thermally developable element, to improve its resistance against abrasion and to prevent its direct contact with components of the apparatus used for thermal development.

The protective layer preferably comprises a binder, which may be solvent soluble (hydrophobic), solvent dispersible, water soluble (hydrophilic) or water dispersible. Among the hydrophobic binders polycarbonates as described in EP-A 614 769 are particularly preferred. Suitable hydrophilic binders are, for example, gelatin, polyvinylalcohol, cellulose derivatives or other polysaccharides, hydroxyethylcellulose, hydroxypropylcellulose etc., with hardenable binders being preferred.

A protective layer according to the present invention may be crosslinked. Crosslinking can be achieved by using crosslinking agents such as described in WO 95/12495 for protective layers. A protective layer according to the present invention may comprise in addition at least one solid lubricant having a melting point below 150° C. and at least one liquid lubricant in a binder, wherein at least one of the lubricants is a phosphoric acid derivative, further dissolved lubricating material. Such protective layers may also comprise particulate material, e.g. talc particles, optionally protruding from the protective outermost layer as described in WO 94/11198. Other additives can also be incorporated in the protective layer e.g. colloidal particles such as colloidal silica.

Suitable slipping layer compositions are described in e.g. EP 138483, EP 227090, U.S. Pat. Nos. 4,567,113, 4,572,860 and 4,717,711 and in EP-A's 311 841, 492 411 and 501 072.

Antistatic Layer

In a preferred embodiment the recording material of the present invention an antistatic layer is applied to the outermost layer on the side of the support not coated with the photo-addressable thermally developable element. Suitable antistatic layers therefor are described in EP-A's 444 326, 534 006 and 644 456, U.S. Pat. Nos. 5,364,752 and 5,472,832 and DOS 4125758.

Coating Techniques

The coating of any layer of the photothermographic materials of the present invention may proceed by any coating technique e.g. such as described in Modern Coating and Drying Technology, edited by Edward D. Cohen and Edgar B. Gutoff, (1992) VCH Publishers Inc. 220 East 23rd Street, Suite 909 New York, N.Y. 10010, U.S.A.

Recording Process

Photothermographic materials, according to the present invention, may be exposed with radiation of wavelength between an X-ray wavelength and a 5 microns wavelength with the image either being obtained by pixel-wise exposure with a finely focused light source, such as a CRT light source; a UV, visible or IR wavelength laser, such as a He/Ne-laser or an IR-laser diode, e.g. emitting at 780 nm, 830 nm or 850 nm; or a light emitting diode, for example one emitting at 659 nm; or by direct exposure to the object itself or an image therefrom with appropriate illumination e.g. with UV, visible or IR light.

For the thermal development of image-wise exposed photothermographic recording materials, according to the present invention, any sort of heat source can be used that enables the recording materials to be uniformly heated to the development temperature in a time acceptable for the application concerned e.g. contact heating, radiative heating, microwave heating etc.

Applications

The photothermographic recording materials of the present invention can be used for both the production of transparencies and reflection type prints. This means that the support will be transparent or opaque, e.g. having a white light reflecting aspect. For example, a paper base substrate is present which may contain white reflecting pigments, optionally also applied in an interlayer between the recording material and the paper base substrate. Should a transparent base be used, the base may be colourless or coloured, e.g. has a blue colour.

In the hard copy field photothermographic recording materials on a white opaque base are used, whereas in the medical diagnostic field black-imaged transparencies are widely used in inspection techniques operating with a light box.

The following ingredients in addition to those mentioned above were used in the photothermographic recording materials of the examples and comparative examples illustrating this invention:

the reducing agents:

- R01: 3-(3',4'-dihydroxyphenyl)propionic acid;
- R02: 3',4'-dihydroxy-butyrophenone;
- R03: 1,5-dihydroxynaphthalene;
- R04: 2-(3',4'-dihydroxyphenyl)acetic acid;
- R05: 3,4-dihydroxybenzoic acid;
- R06: ethyl 2,5-dihydroxybenzoate;
- LOWINOX™ 22IB46: 2-propyl-bis(2-hydroxy-3,5-dimethylphenyl)methane from CHEM. WERKE LOWI;

the dispersion agents:

- ULTRAVON™ W: a sodium salt of an alkaryl sulfonate from CIBA-GEIGY;
- MERSOLAT™ H: a sodium salt of an alkyl sulfonate from BAYER;

and the polymeric binders:

- Butvar™ B79: poly(vinylbutyral) from MONSANTO;
- BINDER 01: copolymer consisting of 45% by weight of methyl-methacrylate, 45% by weight of butadiene and 10% by weight of itaconic acid;
- BINDER 02: NEOCRYL™ A550 from POLYVINYL CHEMIE, a 40% by weight dispersion of poly (methylmethacrylate);
- BINDER 03: METHOCEL™ K4M PREMIUM from DOW CORNING, a hydroxylalkyl-cellulose.

The invention is illustrated hereafter by way of INVENTION EXAMPLES and COMPARATIVE EXAMPLES. The percentages given in these examples are by weight unless otherwise stated.

COMPARATIVE EXAMPLES 1 and 2

The photothermographic recording materials of COMPARATIVE EXAMPLES 1 and 2 comprise a photo-addressable thermally developable layer coated from a solvent dispersion to demonstrate the specificity of the present invention to photothermographic recording materials comprising a photo-addressable thermally developable element coated from an aqueous dispersion.

Preparation of Silver Behenate

A silver behenate emulsion was prepared by adding a solution of 6.8kg of behenic acid in 67L of 2-propanol at 65° C. to a 400L vessel heated to maintain the temperature of its contents at 65° C., converting 96% of the behenic acid to sodium behenate by adding with stirring 76.8L of 0.25M sodium hydroxide in deionized water and finally adding with stirring 48L of a 0.4M solution of silver nitrate in deionized water. Upon completion of the addition of silver nitrate the contents of the vessel were allowed to cool and the precipitate filtered off, washed, slurried with water, filtered again and finally dried at 45° C. for 12 hours.

Preparation of a Silver Behenate Dispersion in 2-Butanone 281.25 g of the dried powder containing 4 mol % behenic acid with respect to silver behenate were predispersed in a solution of 281.25 g of Butvar™ B79 in 1937.5 g of 2-butanone using conventional dispersion techniques and the resulting dispersion homogenized in a MICROFLUIDICS™ M-110Y high pressure microfluidizer at a jet pressure of 400 bar.

Partial Conversion of Silver Behenate to Silver Halide

To 4 g of the silver behenate dispersion, containing 10.7% by weight of silver behenate, 0.3% by weight of behenic acid and 11% by weight of Butvar™ B79, was added with stirring 0.72 g of a 5% by weight solution of PC03 in ethanol, PC03 being present in the resulting mixture in a concentration of 8 mol % with respect to silver behenate.

Coating with a Photo-Addressable Thermally Developable Layer

The coating dispersion of COMPARATIVE EXAMPLE 1 was prepared by adding with stirring 0.16 g of a 5% by weight solution of phthalazine in 2-butanone, followed by 0.74 g of a 20% by weight solution of LOWINOX™ 22IB46 in 2-butanone and finally 1.2 g of 2-butanone to the PC03-containing dispersion of silver behenate.

The coating dispersion of COMPARATIVE EXAMPLE 2 was prepared by adding with stirring 0.6 g of a 5% by weight solution of phthalazine in 2-butanone, followed by 0.74 g of a 20% by weight solution of LOWINOX™ 22IB46 in 2-butanone and finally 0.85 g of 2-butanone to the PC03-containing dispersion of silver behenate.

The resulting dispersions, at a temperature of 30° C., were then doctor blade coated onto a 100μm thick subbed polyethylene terephthalate (PET) support to a wet thickness of 80μm and were allowed to dry on the coating bed for several minutes at 40° C. and then were dried for 1 hour in a hot air oven at 50° C. to produce the photo-thermographic recording materials of COMPARATIVE EXAMPLES 1 and 2.

Image-Wise Exposure and Thermal Processing

The photothermographic recording materials of COMPARATIVE EXAMPLES 1 and 2 were then exposed to ultra-violet light through a test original in contact with the material in an Agfa-Gevaert™ DL 2000 exposure apparatus. Thermal development was carried out in pressure contact with a metal block whose temperature could be varied between 95 and 150° C. Thermal development was carried out on the photothermographic recording materials after maximum exposure and without exposure and the corresponding optical densities, $D_{max}$ and $D_{min}$, were determined in transmission with a MacBeth™ TR924 densitometer with a visual filter. The optical densities obtained with the photothermographic recording materials of COMPARATIVE EXAMPLES 1 and 2 are given in table 1 together with the thermal development conditions used.

TABLE 1

| Recording material of comparative example nr | mol % phthalazine vs. AgBeh* | thermal processing conditions time [s] | thermal processing conditions temperature [° C.] | optical density of image $D_{max}$ | optical density of image $D_{min}$ |
|---|---|---|---|---|---|
| 1 | 6.8 | 5 | 105 | 0.05 | 0.05 |
| 1 | 6.8 | 5 | 120 | 0.05 | 0.05 |
| 1 | 6.8 | 30 | 130 | 0.13 | 0.13 |
| 2 | 25.5 | 5 | 105 | 0.06 | 0.05 |
| 2 | 25.5 | 5 | 120 | 0.08 | 0.05 |
| 2 | 25.5 | 30 | 130 | 1.19 | 1.19 |

*AgBeh = silver behenate

The results show that surprisingly virtually no photothermographic effect, i.e. no image differentiation, could be observed with the photothermographic recording materials of COMPARATIVE EXAMPLES 1 and 2 even using the extreme thermal development conditions of 30s at 130° C. i.e. when silver iodide and the toning agent phthalazine were both present in the materials even at phthalazine concentrations as high as 25.5 mol % with respect to silver behenate (AgBeh).

INVENTION EXAMPLE 1

Preparation of an aqueous dispersion of silver behenate

The dried powder containing 4 mol % behenic acid with respect to silver behenate prepared as described in COMPARATIVE EXAMPLES 1 and 2 was predispersed in deionized water with the anionic dispersion agents Ultravon™ W and Mersolat™ H to produce by rapid mixing with a high speed impingement mill (rotor-stator mixer) to obtain a paste and the resulting dispersion homogenized in a MICROFLUIDICS™ M-110Y high pressure microfluidizer at a jet pressure of 400 bar to produce an aqueous dispersion containing 16.7% by weight of silver behenate, 0.5% by weight of behenic acid, 2.1% by weight of Ultravon™ W and 0.203% by weight of Mersolat™ H. The pH of the dispersion was adjusted to about 6.5.

Partial conversion to photosensitive silver halide and coating, drying and processing of the photothermographic material The following ingredients were then added with stirring to 2.62 g of each of the dispersions produced: 1.5 g of a 30% by weight concentration of BINDER 01 in deionized water at a pH of 4, 3 g of a 1.22% by weight aqueous solution of PC03, corresponding to a concentration of 8 mol % of PC03 with respect to silver behenate, to accomplish in situ conversion of part of the silver behenate to silver iodide at a pH of 4, 0.5 g of a 6.57% by weight aqueous solution of phthalazine and 1.5 g of a 5.4% by weight aqueous solution of R01 at a pH of 4.

A subbed polyethylene terephthalate support having a thickness of 100 μm was then doctor blade-coated with the silver behenate/silver iodide dispersion to a wet layer thickness of 90 μm. After drying for several minutes at 40° C. on the coating bed, the emulsion layer was dried for 1 hour in a hot air oven at 50° C.

Image-wise exposure and thermal development were carried out on the resulting photothermographic recording material of INVENTION EXAMPLE 1 as described for COMPARATIVE EXAMPLES 1 and 2 with thermal development for 5 to 10s at 105° C. and very good images with a high contrast and good sharpness were obtained. This demonstrates that photothermographic recording materials containing both silver iodide and phthalazine when coated from aqueous media exhibit good photothermographic properties upon exposure and thermal development, whereas photothermographic recording materials containing both silver iodide and phthalazine when coated from solvent media exhibit little or no image differentiation.

INVENTION EXAMPLES 2 to 6

The photothermographic recording materials of INVENTION EXAMPLE 2 to 6 were produced as described for that of INVENTION EXAMPLE 1 except that 0.5 g of aqueous solutions of phthalazine with different concentrations as given in table 2 for the particular INVENTION EXAMPLE were substituted for the 0.5 g of a 6.57% by weight aqueous solution of phthalazine. The phthalazine concentration in the resulting photothermographic recording materials, also given in table 2, varies between 5 and 30 mol % with respect to silver behenate.

INVENTION EXAMPLE 7

The photothermographic recording material of INVENTION EXAMPLE 7 was produced as described for that of INVENTION EXAMPLE 2 except that 2.7 g of a 1.22% by weight aqueous solution of PC03 and 0.15 g of a 2.44% by weight solution of PC02 was added instead of 3 g of a 1.22% by weight aqueous solution of PC03.

COMPARATIVE EXAMPLE 3

The photothermographic recording material of COMPARATIVE EXAMPLE 3 was produced as described for that of INVENTION EXAMPLE 1 except that 3 g of a 1.11% by weight solution of PC02 was added instead of 3 g of a 1.22% by weight aqueous solution of PC03.

COMPARATIVE EXAMPLE 4

The photothermographic recording material of COMPARATIVE EXAMPLE 4 was produced as described for that of COMPARATIVE EXAMPLE 3 except that 0.5 g of a 2.6% by weight aqueous solution of phthalazine was added instead of 0.5 g of a 6.57% by weight aqueous solution of phthalazine and therefore contains 10 mol % of phthalazine with respect to silver behenate compared with the 25 mol % of phthalazine with respect to silver behenate of the photothermographic recording material of COMPARATIVE EXAMPLE 1.

COMPARATIVE EXAMPLE 5

The photothermographic recording material of COMPARATIVE EXAMPLE 5 was produced as described for that of INVENTION EXAMPLE 1 except that 0.5 g of deionized water was added instead of 0.5 g of a 6.57% by weight aqueous solution of phthalazine and therefore contains 0 mol % of phthalazine with respect to silver behenate compared with the 25 mol % of phthalazine with respect to silver behenate of the photothermographic recording material of INVENTION EXAMPLE 1.

Post-processing stability of photothermographic recording materials of INVENTION EXAMPLES 1 to 7 and COMPARATIVE EXAMPLES 3 to 5

After image-wise exposure and thermal processing for 5 to 10s at 105° C. the photothermographic recording materials of INVENTION EXAMPLES 1 to 7 and COMPARATIVE EXAMPLES 3 to 5 all exhibited good images with a high contrast and good sharpness. The images were then placed on top of the glass window of a specially constructed light box, as described below, and the evolution of the density obtained without exposure, $D_{min}$, monitored with time. The results obtained are given below in table 2.

The light-box contained a number of evenly spaced fluorescent lamps arranged in such a way that a uniform light flux of 5800 Lux at a colour temperature of 5000K could be obtained in the area of the window on which the materials being evaluated for post-sing light stability were placed.

The results in table 2 show that excellent post-processing light stability is obtained in the photothermographic recording materials of INVENTION EXAMPLES 1 to 7 comprising photosensitive silver halide comprising at least 80 mol % silver iodide and a diazine compound, phthalazine according to the present invention, whereas the photothermographic recording materials of COMPARATIVE EXAMPLES 3 to 5 comprising photosensitive silver bromide and phthalazine or photosensitive silver iodide without a diazine compound exhibited poor post-processing light stability.

TABLE 2

| Recording material invention example nr | AgX present | % by wt in aqueous solution of phthalazine | mol % of phthalazine vs. silver behenate | $D_{min}$-values after 0 h | after 1 h | after 5 h | after 20 h |
|---|---|---|---|---|---|---|---|
| 6 | AgI | 7.66 | 30 | 0.06 | 0.05 | 0.05 | 0.06 |
| 1 | AgI | 6.57 | 25 | 0.07 | 0.06 | 0.06 | 0.07 |
| 2 | AgI | 5.2 | 20 | 0.06 | 0.06 | 0.06 | 0.07 |
| 3 | AgI | 3.83 | 15 | 0.07 | 0.07 | 0.08 | 0.11 |
| 4 | AgI | 2.6 | 10 | 0.09 | 0.07 | 0.10 | 0.20 |
| 5 | AgI | 1.3 | 5 | 0.10 | 0.13 | 0.25 | 0.48 |
| 7 | 89 mol % AgI 11 mol % AgBr | 5.2 | 20 | 0.09 | 0.09 | 0.09 | 0.12 |
| Comparative example nr | | | | | | | |
| 3 | AgBr | 6.57 | 25 | 0.05 | 0.23 | 0.39 | 0.46 |
| 4 | AgBr | 2.6 | 10 | 0.05 | 0.09 | 0.23 | 0.34 |
| 5 | AgI | — | 0 | 0.11 | 0.20 | 0.30 | 0.43 |

INVENTION EXAMPLES 8 to 13

The photothermographic recording materials of INVENTION EXAMPLES 8 to 13 were produced as described for that of INVENTION EXAMPLE 2 except that the 3 g of a 1.22% by weight aqueous solution of PC03 was replaced with solutions of other iodide-containing conversion agents as given in table 3 below.

After image-wise exposure and thermal processing for 5 to 10s at 105° C., as described for INVENTION EXAMPLE 1, the photothermographic recording materials of INVENTION EXAMPLES 8 to 13 all exhibited good images with a high contrast and good sharpness. The images were then placed on top of the glass window of a specially constructed light box, as described above, and the evolution of the density obtained without exposure, $D_{min}$, monitored with time. The results obtained are given below in table 3.

The results in table 3 show that the choice of agent to convert silver behenate into silver iodide had only a marginal effect on the post-processing light stability of the photothermographic recording materials of INVENTION EXAMPLES 8 to 13 with 8 mol % of silver iodide and 20 mol % of phthalazine with respect to silver behenate, according to the present invention.

TABLE 3

| Recording material invention example number | conversion of AgBeh to AgI: iodide conversion agent | aqueous solution concentration [wt.] | weight of solution added [g] | $D_{min}$-values after 0 h | after 1 h | after 5 h | after 20 h |
|---|---|---|---|---|---|---|---|
| 2 | PC03 | 1.22 | 3.0 | 0.06 | 0.06 | 0.06 | 0.07 |
| 8 | SC01 | 0.55 | 3.0 | 0.10 | 0.11 | 0.11 | 0.14 |
| 9 | PC09 | 1.08 | 3.0 | 0.04 | 0.06 | 0.05 | 0.06 |
| 10 | NC08 | 1.00 | 3.0 | 0.13 | 0.14 | 0.16 | 0.25 |
| 11 | IPA | 0.54 | 3.0 | 0.06 | 0.07 | 0.07 | 0.10 |

TABLE 3-continued

| Recording material invention example number | conversion of AgBeh to AgI: iodide conversion agent | aqueous solution concentration [wt.] | weight of solution added [g] | $D_{min}$-values after 0 h | after 1 h | after 5 h | after 20 h |
|---|---|---|---|---|---|---|---|
| 12 | KI | 0.43 | 3.0 | 0.08 | 0.08 | 0.09 | 0.10 |
| 13 | PC03 | 1.22 | 1.5 | 0.13 | 0.14 | 0.15 | 0.18 |
| | KI | 4.40 | 0.15 | | | | |

INVENTION EXAMPLES 14 to 19

The photothermographic recording material used in INVENTION EXAMPLES 14 to 19 were produced as described for that of INVENTION EXAMPLE 2 except that 1.5 g of deionized water was substituted for 1.5 g of a 5.4% by weight aqueous solution of R01 at a pH of 4.

The photothermographic recording material was then doctor blade-coated to wet layer thickness of 30 $\mu$m with solutions of the reducing agents given below in table 4 in the solvents and at the concentrations also given below in table 4 and the resulting photothermographic recording materials of INVENTION EXAMPLES 14 to 19 dried on the coating bed for several minutes at 40° C. followed by 1 hour in a hot air drying cupboard at 50° C.

After image-wise exposure and thermal processing as described for INVENTION EXAMPLE 1 under the thermal processing conditions given below in table 4, the photothermographic recording materials of INVENTION EXAMPLES 14 to 19 all exhibited good images with a high contrast and good sharpness. The exposed and thermally processed photothermographic materials were then placed on top of the glass window of a specially constructed light box, as described above, and the evolution of the density obtained without exposure, $D_{min}$, monitored with time. The results obtained are given in table 4.

TABLE 4

| Recording material invention example number | Reducing agent solution: reducing agent | methanol solution concentration [wt %] | thermal processing: time [s] | temperature [° C.] | $D_{min}$-values after 0 h | after 1 h | after 5 h | after 20 h |
|---|---|---|---|---|---|---|---|---|
| 14 | R01 | 2.44 | 5 | 105 | 0.09 | 0.10 | 0.10 | 0.12 |
| 15 | R02 | 2.41 | 5 | 105 | 0.11 | 0.11 | 0.10 | 0.14 |
| 16 | R03 | 2.14 | 5 | 105 | 0.06 | 0.07 | 0.08 | 0.19 |
| 17 | R04 | 2.2* | 10 | 105 | 0.07 | 0.08 | 0.08 | 0.10 |
| 18 | R05 | 2.06 | 10 | 120 | 0.06 | 0.10 | 0.11 | 0.16 |
| 19 | R06 | 2.44 | 10 | 120 | 0.04 | 0.05 | 0.05 | 0.09 |

*aqueous solution with Ultravon ™ W as dispersion agent

The Results in table 4 show that the choice of reducing agent had only marginal effect on the post-processing light stability of the photothermographic recording materials of INVENTION EXAMPLES 14 to 19 with 8 mol % of silver iodide and 20 mol % of phthalazine with respect to silver behenate, according to the present invention.

INVENTION EXAMPLE 20

The photothermographic recording material of INVENTION EXAMPLE 20 was produced as described for that of INVENTION EXAMPLE 1 except that 2.0 g of deionized water was substituted for 0.5 g of a 6.57% by weight aqueous solution of phthalazine and 1.5 g of a 5.4% by weight aqueous solution of reducing agent R01 at a pH of 4 and the layer containing silver behenate was further coated to a wet layer thickness of 30 $\mu$m with a mixture of 0.5 g of a 6.57% by weight aqueous solution of phthalazine, 1.87 g of a 5.4% by weight solution of reducing agent R01, 1.48 g of deionized water and several drops of a 8.5% by weight aqueous solution of Ultravon™ W. The resulting material, which contained 20mol % of phthalazine with respect to silver behenate, was dried on the coating bed for several minutes at 40° C. and then for 1 hour in a hot air drying cupboard at 50° C.

After image-wise exposure and thermal processing as described for INVENTION EXAMPLE 1, the photothermographic recording material exhibited a good image with a high contrast and good sharpness. It was then placed on top of the glass window of a specially constructed light box, as described above, and the evolution of the density obtained without exposure, $D_{min}$, monitored with time. The results obtained are given below in table 5.

TABLE 5

| Recording material invention example number | $D_{min}$-values after 0 h | after 1 h | after 5 h | after 20 h |
|---|---|---|---|---|
| 1 | 0.07 | 0.06 | 0.06 | 0.07 |
| 20 | 0.08 | 0.08 | 0.08 | 0.10 |

The results in table 5 show that whether the reducing agent and diazine compound are directly incorporated into the silver behenate-containing layer, such as in the photothermographic recording material of INVENTION EXAMPLE 2, or whether they are applied to the silver behenate-containing layer in an aqueous solution subsequently, such as in the photothermographic recording material of INVENTION EXAMPLE 20, had only a marginal effect on the post-processing light stability of these photothermographic recording materials comprising 8 mol % of silver iodide and 20 mol % of phthalazine with respect to silver behenate, according to the present invention.

INVENTION EXAMPLES 21 and 22

The photothermographic recording material of INVENTION EXAMPLE 21 was produced as described for that of INVENTION EXAMPLE 3 except that the layer containing silver behenate was further coated to a wet layer thickness of 40 μm with a mixture of 2.0 g of a 3.83% by weight aqueous solution of phthalazine, 0.3 g of BINDER 02 and 1.7 g of deionized water, resulting in a photothermographic recording material with an overall concentration of phthalazine of 75 mol % with respect to silver behenate.

The photothermographic recording material of INVENTION EXAMPLE 22 was produced as described for that of INVENTION EXAMPLE 3 except that the layer containing silver behenate was further coated to a wet layer thickness of 40 μm with a mixture of 1.5 g of a 3.83% by weight aqueous solution of phthalazine, 0.3 g of BINDER 02 and 2.2 g of deionized water, resulting in a photothermographic recording material with an overall concentration of phthalazine of 60 mol % with respect to silver behenate.

After drying on the coating bed for several minutes at 40° C. and then for 1 hour in a hot air drying cupboard at 50° C., the photothermographic recording materials of INVENTION EXAMPLES 21 and 22 were image-wise exposed and thermally processed as described for INVENTION EXAMPLE 1 and good images with a high contrast and good sharpness were obtained. The thus exposed and thermally processed materials were then placed on top of the glass window of a specially constructed light box, as described above, and the evolution of the density obtained without exposure, $D_{min}$, monitored with time. The results obtained are given below in table 6.

TABLE 6

| Recording material invention example number | silver halide | phthalazine [mol % vs. AgBeh] emulsion layer | phthalazine [mol % vs. AgBeh] overcoated layer | $D_{min}$-values after 0 h | after 1 h | after 5 h | after 20 h |
|---|---|---|---|---|---|---|---|
| 21 | AgI | 15 | 60 | 0.07 | 0.06 | 0.06 | 0.07 |
| 22 | AgI | 15 | 45 | 0.07 | 0.06 | 0.06 | 0.06 |
| 3 | AgI | 15 | — | 0.07 | 0.07 | 0.08 | 0.11 |

The results in table 6 show that the presence of additional phthalazine in an overcoated layer, such as in the photothermographic recording materials of INVENTION EXAMPLES 21 and 22, had only a marginal improving effect on their post-processing light stability compared with the photothermographic recording material of INVENTION EXAMPLES 3 with 8 mol % of silver iodide and 15 mol % of phthalazine with respect to silver behenate, according to the present invention.

INVENTION EXAMPLE 23

The photothermographic recording material of INVENTION EXAMPLE 23 was produced as described for that of INVENTION EXAMPLE 2 except that 3.75 g of a 2% by weight aqueous solution of hydroxyalkyl-cellulose was added instead of 1.5 g of a 30% by weight concentration of BINDER 01 in deionized water at a pH of 4.

After image-wise exposure and thermal processing as described for INVENTION EXAMPLE 1, a good image with a high contrast and good sharpness was obtained. The thus exposed and thermally processed materials was then placed on top of the glass window of a specially constructed light box, as described above, and the evolution of the density obtained without exposure, $D_{min}$, monitored with time. The results obtained are given below in table 7.

TABLE 7

| Recording material of invention example number | silver halide present | mol % of phthalazine vs. silver behenate | BINDER | $D_{min}$-values after 0 h | after 1 h | after 5 h | after 20 h |
|---|---|---|---|---|---|---|---|
| 2 | AgI | 20 | 01 | 0.06 | 0.06 | 0.06 | 0.07 |
| 23 | AgI | 20 | 03 | 0.05 | 0.07 | 0.07 | 0.08 |

The results in table 7 show that the choice of binder, whether water dispersible (invention example 2) or water-soluble (INVENTION EXAMPLE 23) in the photothermographic recording materials of INVENTION EXAMPLES 2 and 23 with 8 mol % of silver iodide and 20 mol % of phthalazine with respect to silver behenate, according to the present invention, had no effect on their post-processing light stability.

Having described in detail preferred embodiments of the current invention, it will now be apparent to those skilled in the art that numerous modifications can be made therein without departing from the of the invention as defined in the following claims.

What is claimed is:

1. A process for producing a photothermographic recording material having a support and a photo-addressable thermally developable element containing a photosensitive silver halide in catalytic association with a substantially light-insensitive silver salt of an organic carboxylic acid, said salt being a silver salt of a fatty acid, an organic reducing agent for said fatty acid silver salt in thermal working relationship therewith, a binder including a water-soluble binder, a water-dispersible binder or a mixture of a water-soluble binder and a water-dispersible binder, and a surfactant, said process comprising the steps of: (i) producing an aqueous dispersion or aqueous dispersions containing said photosensitive silver halide, said fatty acid silver salt, said organic reducing agent for said fatty acid silver salt, said binder and said surfactant, wherein the medium for said dispersion or dispersions is selected from the group consisting of water and mixtures of water and water-miscible organic solvents; and (ii) coating said aqueous dispersion or aqueous dispersions onto said support thereby forming said photo-addressable thermally developable element on said support, wherein at least 90 mol % of said photosensitive silver halide is silver iodide and said aqueous dispersion further contains or said aqueous dispersions further contain a diazine compound being phthalazine or a substituted phthalazine which is at least 10 mol % of said fatty acid silver salt.

2. The process for producing a photothermographic recording material according to claim 1, wherein said diazine compound present is at least 15 mol % of said fatty acid silver salt.

3. The process for producing a photothermographic recording material according to claim 1, wherein said photoaddressable thermally developable element is provided with a protective layer.

4. The process for producing a photothermographic recording material according to claim 1, wherein said photoaddressable thermally developable element further comprises a dye with maximum absorbance in the wavelength range 600 to 1100 nm.

5. The process for producing a photothermographic recording material according to claim 1, wherein said aqueous dispersion or said aqueous dispersions include an aqueous suspension of particles of a substantially light-insensitive silver salt of an organic carboxylic acid produced by simultaneous metered addition of an aqueous solution or suspension of an organic carboxylic acid, or its salt, and an aqueous solution of a silver salt to an aqueous liquid; and said metered addition of said aqueous solution or suspension of said organic carboxylic acid, or its salt, and/or said aqueous.

6. The process for producing a photothermographic recording material according to claim 1, wherein said fatty acid silver salt is silver behenate.

7. The process for producing a photothermographic recording material according to claim 2, wherein said diazine compound present is at least 20 mol % of said fatty acid silver salt.

* * * * *